United States Patent [19]

Anderson et al.

[11] 3,943,942

[45] Mar. 16, 1976

[54] SMOKING MIXTURES

[75] Inventors: Robert Craig Anderson; Alan James Herd, both of Manchester, England

[73] Assignee: Imperial Chemical Industries Limited, London, England

[22] Filed: June 21, 1974

[21] Appl. No.: 482,026

[30] Foreign Application Priority Data

July 9, 1973 United Kingdom ..... 32503/73

[52] U.S. Cl. ..... 131/17 R; 131/2

[51] Int. Cl.[2] A24B 3/14; A24B 13/00; A24B 15/08

[58] Field of Search ..... 131/2, 15, 17, 140–144

[56] References Cited

UNITED STATES PATENTS

| | | | |
|---|---|---|---|
| 2,809,904 | 10/1957 | Koree | 131/2 |
| 3,477,865 | 11/1969 | Armbrust et al. | 131/17 R X |
| 3,545,448 | 12/1970 | Mormon et al. | 131/2 |
| 3,608,560 | 9/1971 | Briskinet et al. | 131/2 |
| 3,628,541 | 12/1971 | Buchmann et al. | 131/140 C |

*Primary Examiner*—Robert W. Michell
*Assistant Examiner*—V. Millin
*Attorney, Agent, or Firm*—Cushman, Darby & Cushman

[57] ABSTRACT

Tobacco substitutes containing alkaline inorganic matter such as to produce a slurry pH of 8.5 to 13, especially sodium carbonate producing a slurry pH of 9 to 10, and blends of such substitutes with tobacco.

10 Claims, No Drawings

SMOKING MIXTURES

This invention relates to smoking mixtures.

In view of the widely held opinion that the smoking of tobacco, especially in cigarette form, can cause lung cancer and bronchitic ailments attention is turning to the provision of smoke-producing substrates which produce less tar and other harmful substances than tobacco, for example to cellulose, oxidised cellulose and particularly to heat-treated cellulose prepared for example by the process described and claimed in United Kingdom Patent No. 1,113,979.

Most cigarette smokers, however, continue in the habit as a result of "satisfaction" due to the pharmacological effect which they derive from tobacco. This sensation of satisfaction can only be assessed by actual smoking of cigarettes. It is not to be confused with the flavour effect of the cigarette and its assessment is to be regarded as an estimation of the effect on the smoker's need to light another cigarette after finishing a previous one.

Nicotine is one ingredient producing this effect of satisfaction. Tobacco substitutes do not provide satisfaction to smokers unless they are either fortified by nicotine or other compounds giving the pharmacological effect or are blended with tobacco. Nicotine, however, is expensive and it is unstable when added to tobacco substitutes; and of course blending of a substitute with tobacco results in a smoke containing tar and other harmful ingredients, though in a proportion less than that found in the smoke from tobacco alone. When tobacco is blended with a tobacco substitute, therefore, it is desirable for the tobacco content of the blend to be low.

Moreover only about 15 percent of the nicotine in a tobacco cigarette is normally received by the smoker. Thus a normal tipped cigarette contains about 18 mg of nicotine of which only about 1.5 mg (or 2.5 mg without the filter) is received by the smoker. Cigarettes delivering much less than about 1.0 mg of nicotine are generally found unacceptable to the United Kingdom and similar markets.

The invention provides a tobacco substitute containing alkaline inorganic matter such that on slurrying with water to give a 15 percent solution/suspension it produces a liquor having a pH of the range 8.5 to 13, especially 9 to 12, said tobacco substitute being in a form suitable for blending with tobacco, whereby to increase the nicotine delivery in the smoke from the tobacco.

Blends of tobacco with such tobacco substitutes form a further feature of the invention. They give more "satisfaction" to the smoker than comparable blends in which the tobacco substitute produces a liquor of lower pH.

Slurrying with water, to provide a liquor for ascertaining pH may be carried out by mixing well, or by grinding in cases where particles need to be disrupted.

The expression "tobacco substitute" means any solid substance which, though not of tobacco origin can be smoked in the same way as tobacco. Tobacco substitutes may be of carbohydrate origin. Cellulose, in natural or regenerated form, starch and modified carbohydrates for example ethers of starch and cellulose, (particularly carboxymethyl cellulose and its salts) oxidised cellulose and thermally degraded carbohydrates, have all been proposed as the basis of tobacco substitutes.

Advantageously the tobacco-substitute may be based on a thermally degraded carbohydrate made by subjecting carbohydrate (particularly cellulose) to a catalysed degradation process at above 100° (e.g. 100° to 250° as in our British Patent No. 1,113,979) until the weight of the degraded carbohydrate is less than 90 percent of the weight of the original carbohydrate. A similar substance is obtainable as described and claimed in our British Patent No. 1,298,374 by acid or base catalysed condensation of a compound of the formula:

$$R^1COCH_2CH_2COR^2 \qquad (I)$$

wherein $R^1$ and $R^2$, which may be the same or different, each represents a hydrogen atom or an alkyl, hydroxyalkyl, or formyl group or a precursor of such compound (I).

Alkaline inorganic matter contained in the tobacco substitute may be for example lime or magnesia or sodium, potassium or ammonium carbonate or bicarbonate, or sodium or potassium hydroxide. Essentially, the proportion of alkaline inorganic matter in the tobacco substitute must be such as to produce liquor of the aforesaid pH upon mixing with water. Of course the proportion will depend upon the pH of the combustible material upon which the tobacco substitute is based, and upon the particular alkaline inorganic material used. Thus when sodium or potassium hydroxide is used the proportion will necessarily be less than when a noncaustic alkali, such as lime or sodium or potassium carbonate is used.

To provide noteable benefit in reducing the amount of tar and other harmful ingredients in the smoke the blends of the invention should contain not more than 90 percent, and preferably not more than 80 percent by weight of tobacco. On the other hand, in order to provide some satisfaction to the smoker the blends should desirably contain at least 10 percent and preferably at least 20 percent of tobacco.

Conveniently the alkaline inorganic material may be incorporated in the tobacco substitute during its fabrication into a sheet form, which may also contain a binder and any other desired ingredients for example glow-promoting catalysts, materials to improve (or further improve) ash coherence, colouring matters, humectants, fillers and flavourants. The sheet may then be shredded into a form resembling tobacco and thereafter blended with tobacco by known tobacco blending techniques to produce the blends of the invention.

The preferred alkaline inorganic matter to be contained in the tobacco substitute is sodium carbonate. This particular alkali, in addition to enhancing the satisfaction experienced by smokers of the blends, improves the cohesion of the ash and inhibits the tendency of the tobacco substitute to "degrade" physically into a powdery form during processing. Ash cohesion and "degradation" problems are prevalent in tobacco substitutes which contain large amounts of inorganic matter, for example more than 40 percent by weight of inorganic matter. The incorporation in such tobacco substitutes of sufficient sodium carbonate to produce a liquor of pH 9 to 10 greatly improves the ash cohesion and inhibits degradation.

Our UK Patent No. 1,299,296 describes and claims a smoking mixture (a tobacco substitute) comprising a. as smoke producing fuel a solid organic combustible material other than tobacco b. a harmless inorganic filler c. sufficient binder to enable the mixture to be fabricated, said filler being present in a proportion of 40 to 65 percent by weight of the mixture and the combination of cations and anions in the filler being such as to impart a commercially acceptable burning rate to the mixture.

It is a further feature of our invention to provide a tobacco substitute as defined in the preceding paragraph having the further characteristic that the filler includes sodium carbonate in such proportion that the smoking mixture, on slurrying with water to give a 15 percent solution/suspension, produces a liquor having a pH in the range 9 to 10. Such a tobacco substitute may advantageously be blended with tobacco as previously indicated.

In a copending Application of even date we describe a smoking composition comprising a tobacco substitute in admixture with a solid residue obtained by removal of nicotine from *Nicotiana Rustica*. Such a solid residue may contain alkaline inorganic matter, particularly lime. The incorporation of such a residue with a tobacco substitute can therefore provide a flavoured tobacco substitute which is suitable for use in the blends of the present invention since the alkaline inorganic matter in the residue can increase the satisfaction arising from the tobacco.

According to yet a further feature of the invention the tobacco substitute to be used in the blends hereinbefore defined may additionally contain up to 5 percent by weight of a substance which upon heating decomposes with the production of ammonia, any other gaseous decomposition products thereof being non-toxic.

Ammonia-producing substances which may be contained in the tobacco substitute include ammonium salts such as the sulphate, carbonate, bicarbonate or acetate, amides such as urea and biuret, lower amino carboxylic acids such as glycine and alanine and amidines such as guanidine.

It is found that the presence of such ammonia-producing substances further enhances the satisfaction resulting from inclusion of the alkaline inorganic matter in the blends.

The invention is illustrated but not limited by the following Examples in which all parts and percentages are by weight:

Thermally degraded cellulose used in the Examples was made by impregnating cellulose with 10 percent ammonium sulphamate solution, compressing until the cellulose retained its own weight of the solution, drying at 45°C and then heating at 265°C until a loss in weight of 25–30 percent occurred.

Smoking mixtures were made by slurring the ingredients in water, casting on to a drier to give a film with a dry-basis weight of 48–52 g/sq.m., and drying and shredding the film. The mixtures in shredded form were blended with tobacco, made up into cigarettes and test-smoked for comparison against appropriate mixtures, so that the effect of particular constituents could be ascertained.

EXAMPLE 1

A shredded smoking mixture was made, containing the following ingredients

| | Parts |
|---|---|
| Thermally degraded cellulose | 10.44 |
| Glycerol | 2.32 |
| Calcium carbonate | 6.40 |
| Magnesium carbonate | 11.08 |
| Bentonite | 1.96 |
| Sodium carbonate | 2.00 |
| Sodium carboxymethylcellulose | 5.80 |

The slurry pH of the mixture was 9.5. Slurry containing no sodium carbonate had a pH of 7.2. The mixture, and an otherwise identical mixture containing no sodium hydroxide were each blended with an equal weight of flue-cured Virginia tobacco and made up into cigarettes. Test smoking showed that the blend from the mixture containing sodium carbonate gave more satisfaction than the other blend.

EXAMPLE 2

A shredded smoking mixture was made, containing the following ingredients:

| | Parts |
|---|---|
| Thermally degraded cellulose | 10.64 |
| Glycerol | 2.36 |
| Calcium carbonate | 6.52 |
| Magnesium carbonate | 11.32 |
| Bentonite | 2.00 |
| Sodium hydroxide | 1.20 |
| Sodium carboxymethylcellulose | 5.86 |

The slurry pH of the mixture was 11.8. Slurry containing no sodium hydroxide had a pH of 7.2. The mixture, and an otherwise identical mixture containing no sodium hydroxide were each blended with an equal weight of flue-cured Virginia tobacco and made up into cigarettes. Test smoking showed that the blend from the mixture containing sodium hydroxide gave more satisfaction than the other blend.

EXAMPLE 3

A shredded smoking mixture was made, containing the following ingredients

| | Parts |
|---|---|
| Thermally degraded cellulose | 10.20 |
| Glycerol | 2.28 |
| Calcium carbonate | 6.28 |
| Magnesium carbonate | 10.84 |
| Bentonite | 1.88 |
| Sodium carbonate | 2.00 |
| Urea | 0.80 |
| Sodium carboxymethyl cellulose | 5.72 |

The slurry pH of the mixture was 9.4. The mixture, and an otherwise identical mixture containing no urea (i.e. the mixture denoted in Example 1) were each blended with an equal weight of flue-cured Virginia tobacco and made up into cigarettes. Test smoking showed that the blend from the mixture containing urea gave more satisfaction than the other blend.

EXAMPLE 4

A shredded smoking mixture was made, containing the following ingredients

| | Parts |
|---|---|
| Thermally degraded cellulose | 10.20 |
| Glycerol | 2.28 |
| Calcium carbonate | 6.28 |
| Magnesium carbonate | 10.88 |
| Bentonite | 1.88 |
| Sodium carbonate | 2.00 |
| Ammonium sulphate | 0.76 |
| Sodium carboxymethyl cellulose | 5.72 |

The slurry pH of the mixture was 8.9. Slurry containing no sodium carbonate had a pH of 7.1. The mixture, and an otherwise identical mixture containing no sodium carbonate were each blended with an equal weight of flue-cured Virginia tobacco and made up into cigarettes. Test smoking showed that the blend from the mixture containing sodium carbonate gave more satisfaction than the other blend.

EXAMPLE 5

A shredded smoking mixture was made, containing the following ingredients.

| | Parts |
|---|---|
| Thermally degraded cellulose | 10.44 |
| Glycerol | 2.32 |
| Calcium carbonate | 6.40 |
| Magnesium carbonate | 11.08 |
| Bentonite | 1.96 |
| Lime (calcium oxide) | 1.20 |
| Urea | 0.80 |
| Sodium carboxymethyl cellulose | 5.80 |

The slurry pH of the mixture was 11.8. Slurry containing no sodium hydroxide had a pH of 7.3. The mixture, and an otherwise identical mixture containing no lime were each blended with an equal weight of flue-cured Virginia tobacco and made up into cigarettes. Test smoking showed that the blend from the mixture containing lime gave more satisfaction than the other blend.

Examples 6, 7 and 8 relate to smoking mixtures containing sodium carbonate. The following ash cohesion test was used in these Examples.

A group of 10 cigarettes are smoked on a standard smoking machine which takes a 35 ml puff of 2 seconds duration every minute. Each cigarette is smoked separately in a draught-free and vibration-free enclosure and the ash cylinder first falling from the cigarette is weighed on a microbalance. The total ash obtained by smoking the complete cigarette is also weighed. The average percentage ratio of the weight of the first-falling cylinder to the total weight of ash is referred to as the bulk ash cohesion value.

Relative bulk ash cohesions were also assessed by panels of smokers, who also assessed the flake ash cohesion i.e. the tendency for small flakes to fall from the cylinder of ash during smoking.

Degradation properties were measured by sieving portions of material taken from the cigarette-forming trough of a Molins Mark VI cigarette machine. The percentage by weight of material passing a sieve of 0.65 mm. mesh is recorded as the percentage degradation.

EXAMPLE 6

A shredded smoking mixture was made containing the following ingredients.

| | Parts |
|---|---|
| Thermally degraded cellulose | 10.76 |
| Glycerol | 2.40 |
| Calcium carbonate | 8.84 |
| Magnesium carbonate | 8.00 |
| Sodium carbonate | 2.00 |
| Sodium carboxymethylcellulose | 6.00 |
| Ammonium sulphate | 0.80 |

The slurry pH of the mixture was 8.6.

The percentage degradation (as defined above) of this mixture was 2 percent compared with 4 to 6 percent for an otherwise identical mixture containing no sodium carbonate.

The mixture was blended with an equal weight of flue-cured Virginia tobacco and made up into cigarettes. These were smoked on a standard smoking machine and their bulk ash cohesion measured as described above was 45 compared with 30 for an otherwise identical smoking mixture containing no sodium carbonate.

A panel of smokers rated these cigarettes to have better bulk and flake ash cohesion than cigarettes from the composition without sodium carbonate.

EXAMPLE 7

A shredded smoking mixture was made containing the following ingredients:

| | Parts |
|---|---|
| Thermally degraded cellulose | 10.76 |
| Glycerol | 2.40 |
| Calcium carbonate | 8.84 |
| Magnesium Carbonate | 8.00 |
| Sodium carbonate | 3.20 |
| Sodium carboxymethylcellulose | 6.00 |
| Ammonium sulphate | 0.80 |

The slurry pH of the mixture was 9.3.

The percentage degradation (as defined above) of this mixture was 2 percent compared wtih 4 to 6 percent for an otherwise identical mixture containing no sodium carbonate.

The mixture was blended with an equal weight of flue-cured Virginia tobacco and made up into cigarettes. These were smoked on a standard smoking machine and their bulk ash cohesion measured as described above was 60 compared with 30 for an otherwise identical smoking mixture containing no sodium carbonate.

EXAMPLE 8

A shredded smoking mixture was made containing the following ingredients:

| | Parts |
|---|---|
| Thermally degraded cellulose | 10.76 |
| Glycerol | 2.40 |
| Calcium carbonate | 8.32 |
| Magnesium carbonate | 7.72 |
| Sodium carbonate | 4.00 |
| Sodium carboxymethylcellulose | 6.00 |
| Ammonium sulphate | 0.80 |

The slurry pH of the mixture was 9.4.

The percentage degradation (as defined above) of this mixture was 2 percent compared with 4 to 6 percent for an otherwise identical mixture containing no sodium carbonate.

The mixture was blended with an equal weight of flue-cured Virginia tobacco and made up into cigarettes. These were smoked on a standard smoking machine and their bulk ash cohesion measured as described above was 70 compared with 30 for a smoking mixture containing no sodium carbonate.

What we claim is:

1. A thermally degraded carbohydrate tobacco substitute made by subjecting a carbohydrate to a catalyzed thermal degradation at a temperature above 100°C until the weight of the degraded carbohydrate is less than 90 percent of the weight of the original carbohydrate, said substitute containing sufficient sodium carbonate such that slurrying the substitute with water yields a 15 percent solution/suspension and a liquor having a pH in the range of 8.5 to 13, said substitute being in a form suitable for blending with tobacco to increase nicotine delivery in the smoke from the tobacco where this is considered necessary or desirable.

2. A tobacco substitute according to claim 1 which on slurrying produces a liquor having a pH in the range 9 to 12.

3. A tobacco substitute according to claim 1 wherein the degraded carbohydrate is thermally degraded cellulose.

4. A tobacco substitute according to claim 1 additionally containing up to 5 percent by weight of a substance which upon heating decomposes with the production of ammonia, any other gaseous decomposition products thereof being non-toxic.

5. A tobacco substitute according to claim 4 wherein the ammonia-producing substance is ammonium sulphate.

6. A tobacco substitute according to claim 4 wherein the ammonia-producing substance is urea.

7. A blend of tobacco with a tobacco substitute according to claim 1.

8. A blend according to claim 7 comprising from 10 to 90 percent by weight of tobacco.

9. A blend according to claim 7 comprising from 20 to 80 percent by weight of tobacco.

10. A tobacco substitute comprising a. as smoke-producing fuel a solid organic combustible material other than tobacco, said material being based on a thermally degraded carbohydrate made by subjecting carbohydrate to a catalyzed degradation process at above 100°C until the weight of the degraded carbohydrate is less than 90 percent of the weight of the original carbohydrate;

b. a harmless inorganic filler and c. sufficient binder to enable the material to be fabricated, said filler being present in a proportion of 40 to 65 percent by weight of the mixture and the combination of cations and anions in the filler being such as to impart a commercially acceptable burning rate to the mixture, and having the further characteristic that the filler includes sodium carbonate in such proportion that the tobacco substitute on slurrying with water to give a 15 percent solution/suspension produces a liquor having a pH in the range 9 to 10.

* * * * *